US007402058B2

(12) United States Patent
Hoemann et al.

(10) Patent No.: US 7,402,058 B2
(45) Date of Patent: Jul. 22, 2008

(54) PLUG CONNECTOR WITH SHORT CIRCUIT CONTACTS

(75) Inventors: Norbert Hoemann, Brakel (DE); Rudolf Merz, Detmold (DE); Heinz Reibke, Bad Salzuflen (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 11/741,904

(22) Filed: Apr. 30, 2007

(65) Prior Publication Data

US 2007/0249228 A1 Oct. 25, 2007

(51) Int. Cl.
*H01R 29/00* (2006.01)

(52) U.S. Cl. ..... 439/188; 439/944

(58) Field of Classification Search ..... 439/188, 439/507–514, 723, 724, 944
See application file for complete search history.

(56) References Cited

U.S. PATENT DOCUMENTS 4,685,887 A * 8/1987 Hanning ..... 439/188
4,904,196 A * 2/1990 Sueyoshi et al. ..... 439/188
5,263,872 A * 11/1993 Marpoe et al. ..... 439/188
5,288,250 A * 2/1994 Sumida ..... 439/701
5,405,268 A * 4/1995 Gazzara et al. ..... 439/188
5,466,168 A * 11/1995 Liebich et al. ..... 439/188
5,509,817 A * 4/1996 Tsuji ..... 439/188
5,716,241 A * 2/1998 Hennemann et al. ..... 439/716
6,336,831 B1 * 1/2002 Abe ..... 439/701
6,942,510 B2 * 9/2005 Nakamura ..... 439/188

* cited by examiner

*Primary Examiner*—Truc Nguyen
*Assistant Examiner*—X. Chung-Trans
(74) *Attorney, Agent, or Firm*—Bourque and Associates PA

(57) ABSTRACT

A plug connector consisting of a plug body (1) and an engaging part (2) is provided with short-circuiting contacts (9, 10) within the plug body. The engaging part (2) includes at least one separating element (11) of insulating material that is inserted between the short circuit contacts (9, 10) when plug body (1) and engaging part (2) are inserted to interrupt the short circuit. For the purpose of simpler matching to the quantity of conductors to be short-circuited and to be connected, the plug body (1) and the engaging part (2) each consist of modules (3, 4) that may be stacked one upon the other and are assigned to each of the conductors within the plug body (1) that are of varying polarity and that are to be short-circuited. The short circuit contacts (9, 10) of the plug body (1) are so arranged on the modules (3) that each is extended to the short circuit contacts (9, 10) working together for two adjacent plug body modules (3). The engaging part modules (4) include a separating element (11) that is inserted between two adjacent plug body modules (3) to separate the short circuit contacts (9, 10) during the plugging process.

11 Claims, 7 Drawing Sheets

PLUG CONNECTOR WITH SHORT CIRCUIT CONTACTS

TECHNICAL FIELD

The invention relates to a plug connector with short circuit contacts positioned within the plug body.

BACKGROUND INFORMATION

Such a plug connector is known from DE 694 04 891 T2. In this known implementation, all differently-polarized conductors are surrounded by a design unit both within the plug body and within the engaging part. In contrast to what is shown in the named document, plug connectors of such type may also be three-poled or more, whereby the plug body and the engaging part for each of these versions represent a suitably-dimensioned design unit and thus require an individual housing for each. One might resort to the option of using two or more bi-polar plug connectors for a higher number of variously-polarized, mutually short-circuiting conductors.

SUMMARY

It is the task of the invention to provide a plug connector of the above-mentioned type that is so designed that it may be particularly simply matched to the quantity of conductors to be connected and the quantity of conductors to be short-circuited.

The plug connector according to the present invention includes both the plug body and the engaging part, and is assembled using two or more identical modules with correspondingly identical housings depending on whether a bi-polar or multi-polar plug connector is involved. The modules that are fixed relative to each other and are securely attached to teach other result first in a plug body and second in a engaging part that may be plugged together and again separated in the normal manner, whereby it is ensured during the separation process that the closing of the short circuit contacts is performed before the plug body and the engaging part lose mechanical contact with each other.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
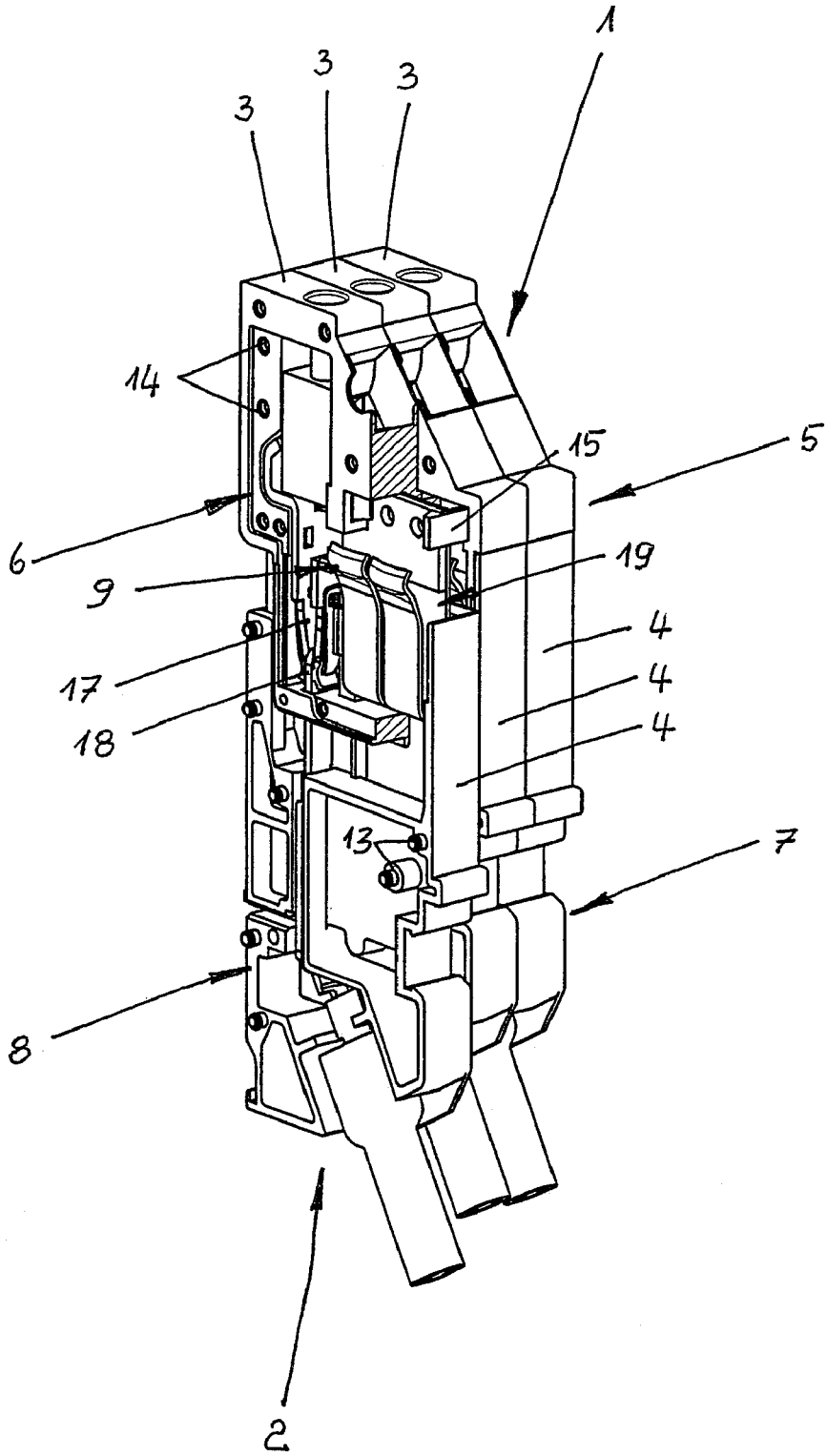
FIG. 1 is a perspective view of a plug connector consisting of a modular plug body and a modular engaging part according to the present invention.
Figure 2:
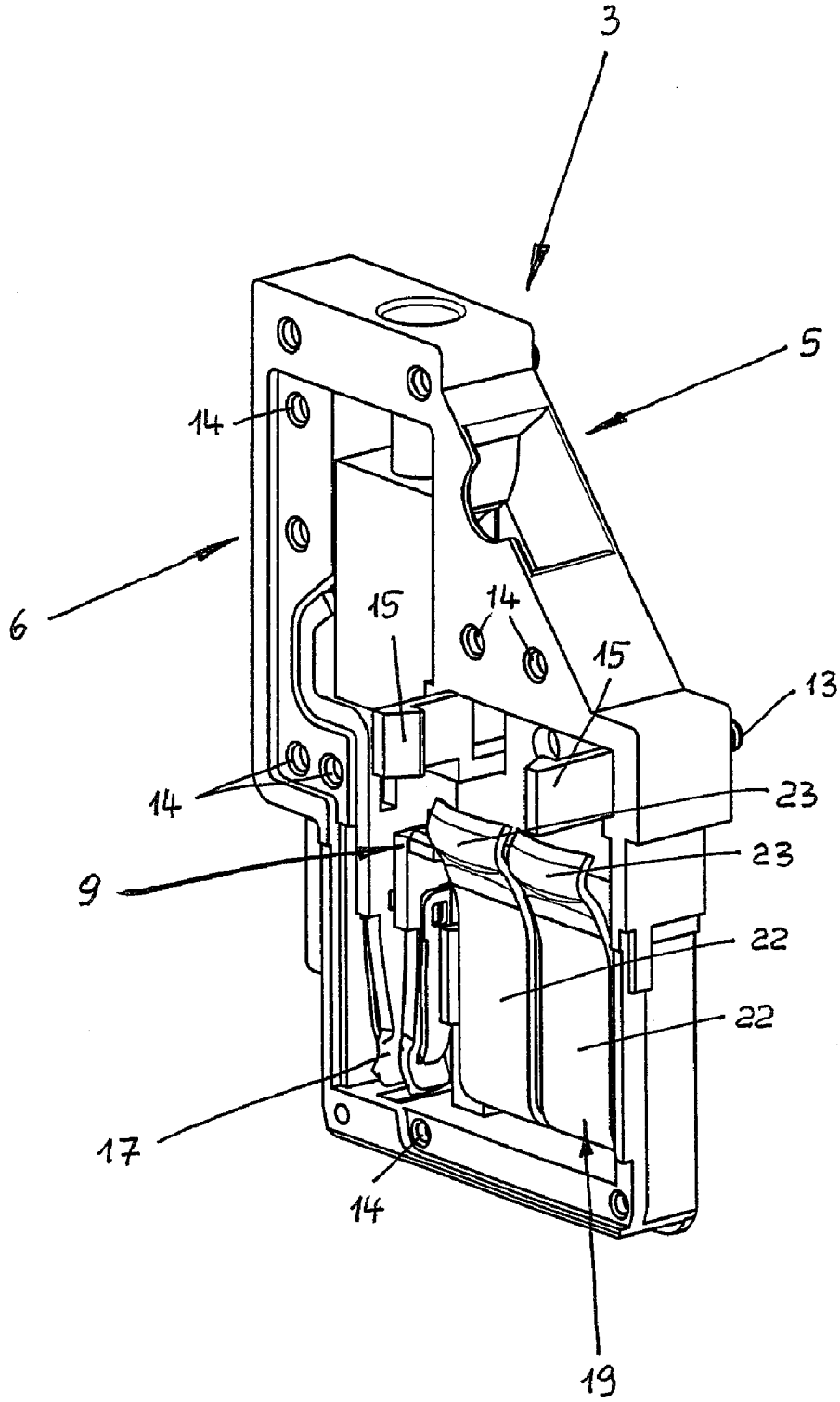
FIG. 2 is a perspective view of one of the modules of the plug connector part of the plug connector as in FIG. 1.
Figure 3:
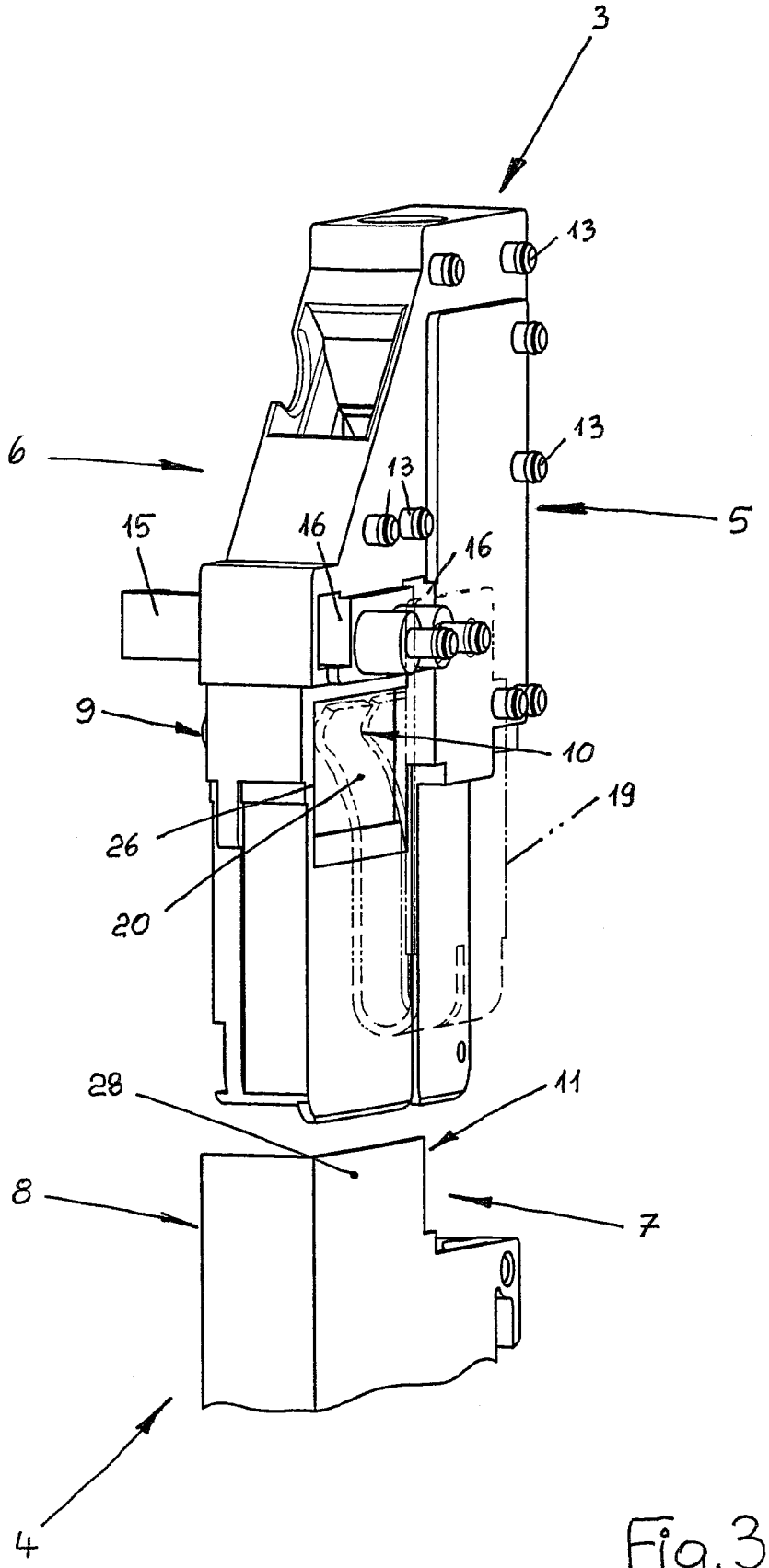
FIG. 3 is another perspective view of the modular plug body as in FIG. 2.

Specifically, FIG. 1 shows a plug connector with a plug body 1 that is composed of three plug body modules 3. Also, the engaging part 2 plugged together with the plug body 1 is composed of three engaging part modules 4. The engaging part module 4 to the left of the Illustration is shown displaced from the plugged final position merely to reproduce specific components. The plug body modules 3 are identical with each other, and the engaging part modules 4 are also identical with each other. The plug body modules possess broad sides 5 and 6 by means of which they may be stacked together congruently, as FIGS. 2 and 3 show. Thus, the one broad side forms the first joint side 5, and the other broad side forms the second joint side 6 of the plug body module 3. The engaging part modules 4 are similarly shaped, and include a first joint side 7 and a second joint side 8. Thus, the plug body modules 3 possess the identical housing shape as do the engaging part modules 4.

On the joint sides 5, 6 of the plug body modules 3 and on the joint sides 7, 8 of the engaging part modules 4 projecting plug lugs 13 are located first, and then secondly, recessed plug sockets 14 that affix the stacked modules 3, 4 are located along their broad direction into a congruent stack to each other. Attachment of modules 3, 4 to each other is ensured first by means of engaging hooks 15 positioned above the second joint sides 6, 8 and second, by means of collaborating engaging members 16 located on the second, opposing joint sides 5, 7.

Each module 3 of the plug body 1 is assigned to one of the polarized conductors to be inserted into the module 3, said conductor being in electrical contact in the plugged position with that conductor within the plugged engaging part 4 that is assigned to the same voltage polarity. For this connection, a working contact 17 in the form of a tulip contact is provided within the plug body module 3, and a working contact 18 in the form of a shaft capable of being inserted into the tulip-shaped working contact 17.

The plug connector is provided with short circuit contacts 8, 9 within the plug body 1 in order to short-circuit together the variously-polarized conductors of the plug body when not in a plugged condition. This short circuit thus occurs when, upon separation of the plug connector, the plug body 1 and the engaging part 2 are still mechanically engaged, and also the working contacts 17 and 18 of all plug body modules 3 and engaging part modules 4 are still in contact with one another. Only in the final plugged position are the short circuit contacts 9, 10 separated from each other, which also means that, when plugging the plug body 1 and the engaging part 2 together, the working contacts 17 and 18 of the plug body modules 3 and the engaging part 4 modules assigned to each close before the short circuit between the variously-polarized conductors of the plug body 1 is removed.

Figure 4:
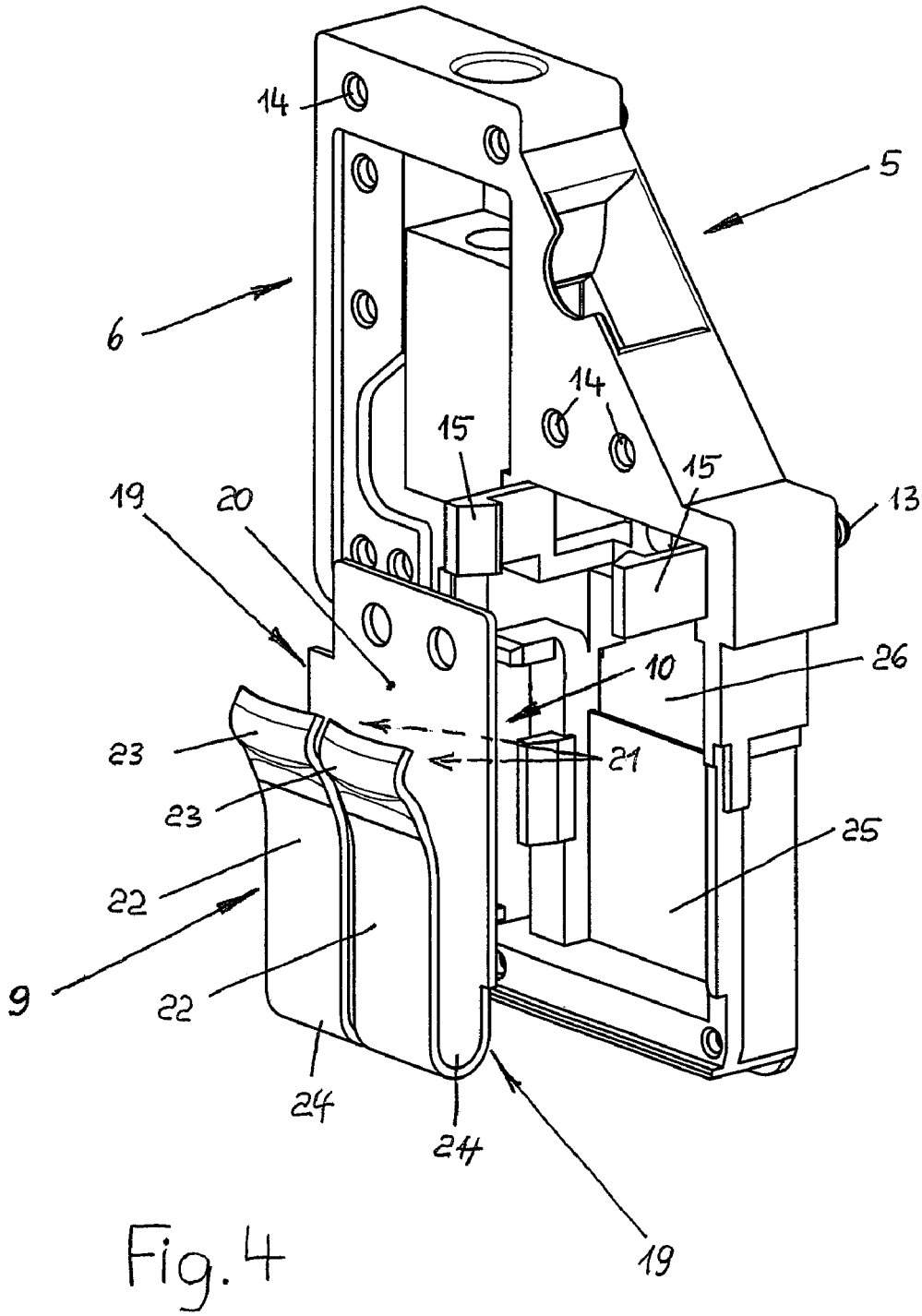
FIG. 4 is a view of the modular plug body as in FIG. 2 with a disengaged reset short circuit contact piece.
Figure 5:
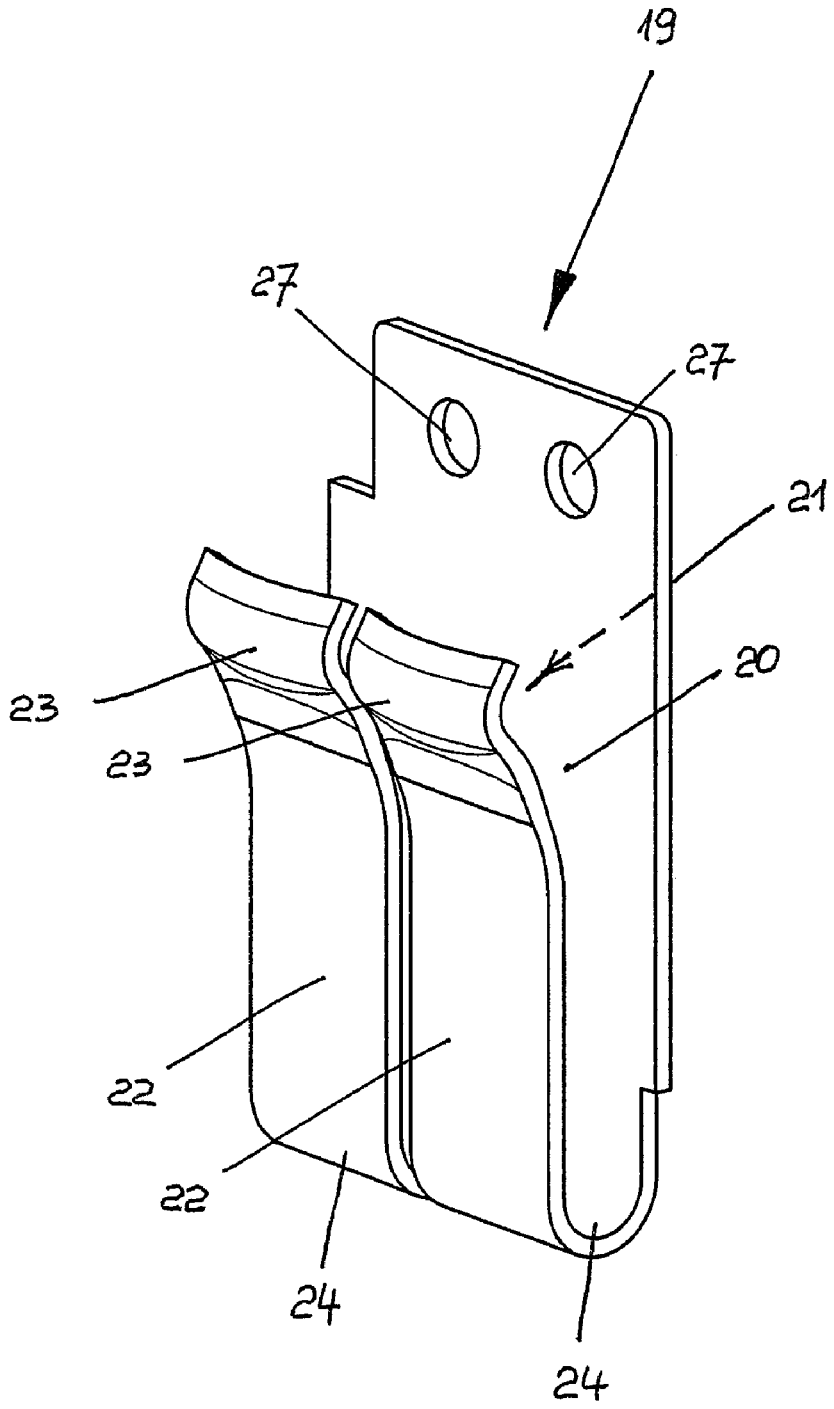
FIG. 5 is a perspective view of the short circuit contact piece of the modular plug body.

The peculiarity of the short circuit contacts 9, 10 first consists of the fact that they are commonly formed as spring contacts 9 and as counter-contacts 10 on a contact piece 19 positioned within the plug body modules. Specifically, the configuration of the one-piece contact piece may be seen in FIGS. 4 and 5. The contact piece 19 includes a rearward, flat plate 20 with attachment holes 27. On its underside, the plate 20 continues with bending joints bent approximately 180° backward that transform into two spring legs 22 parallel with each other. On their upper ends, the spring legs 22 are provided with arched sections, each of whose outer face areas forms a contact position 23. The spring legs 22 with their contact positions 23 thus form two spring contacts 9 positioned adjacent to each other. The counter-contact 10 is formed by a contact area located on the rear side of the contact plate 20 that is of the same height as the contact positions 23 of the spring legs 22, and it is dimensioned suitably for the positioning of the contact positions 23 of two such spring legs 22 that are present at the contact piece 19 of the plug body module 3 adjacent to each plug body module 3.

Figure 6:
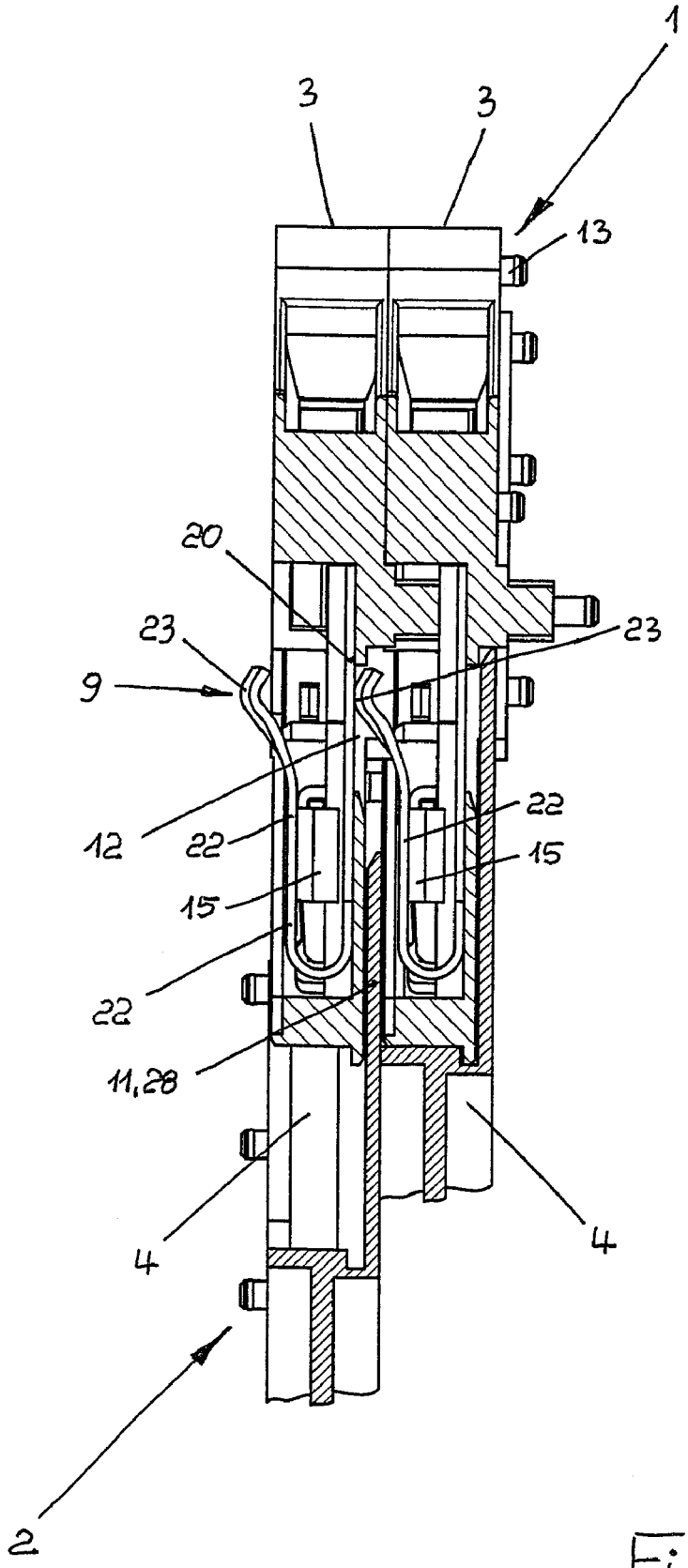
FIG. 6 is a longitudinal cutaway view through a plug connector formed of two plug body modules and two engaging part modules at an intermediary position during the plugging process.
Figure 7:
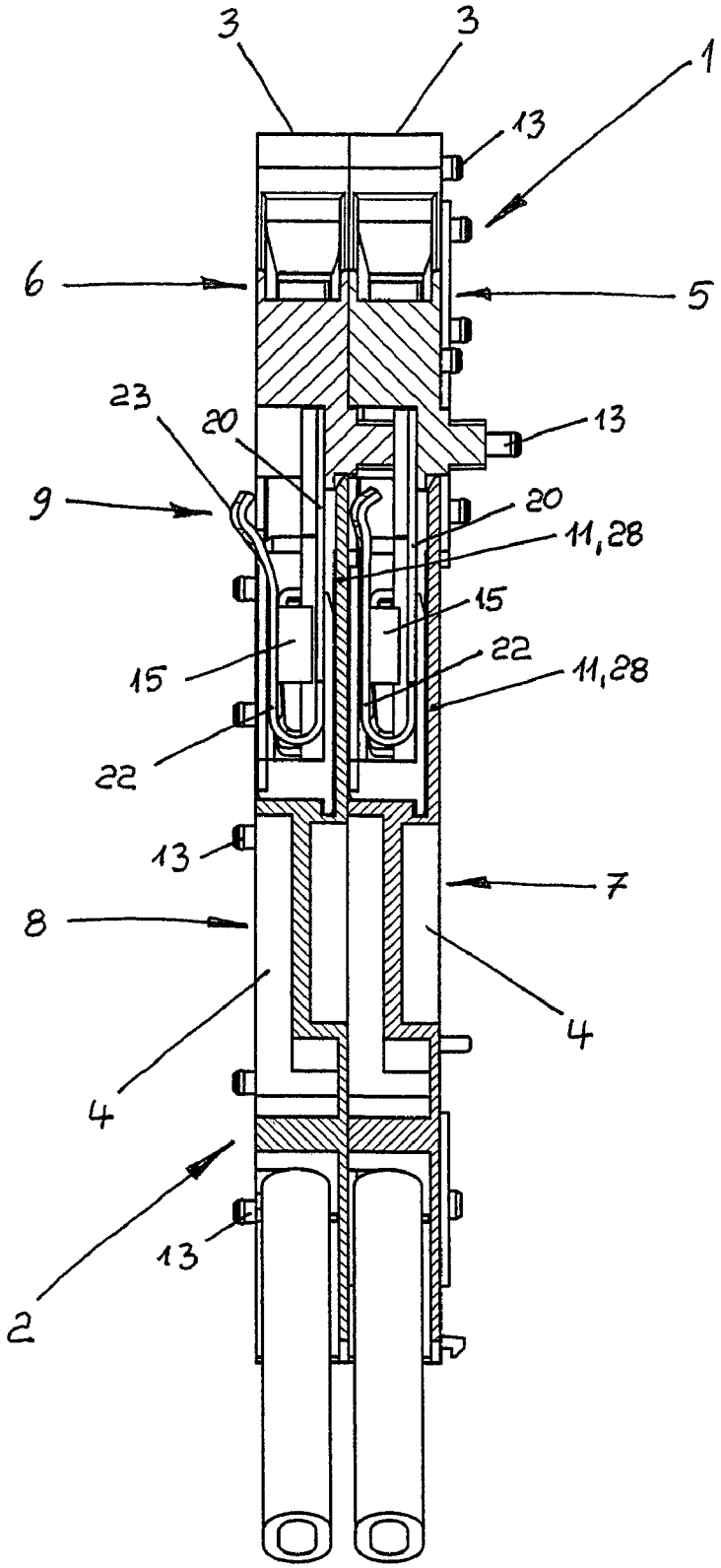
FIG. 7 is a plug connector from FIG. 6 in the same view in a final plugged position.

The rear-side contact area 21 of the contact plate 20 at contact piece 19 is exposed in the installation position on the first joint side 5 of the plug body module 3. As one may see in FIG. 4, a window 26 is provided above a wall 25 of the module housing that is located on the first joint side 5 of the module 3, and through which the contact positions 23 of the spring contacts 9 on the contact piece 19 of the module 3 adjacent to the joint side 5 reach, and may rest against the contact area 21 of the contact plate 20. In FIG. 3, the contact piece 19 of the adjacent module 3 is shown using dotted lines. FIGS. 6 and 7 show in greater detail that, in the non-contact, relaxed position, the spring legs 22 with their contact positions 23 project toward the second joint side 6 of the plug body module 3, and that sufficient spring travel area is available for positive contact.

It may further be seen from FIGS. 6 and 7 that separation of the short circuit contacts, i.e., of the spring contacts 9 and the counter-contacts 10 of the plug body module 3 occurs in the final plugged position. The plug body modules 3 are so contoured on their joint sides 5, 6 that, in inserted position of the plug body module 3, a joint space 12 results between the joint sides 5, 6 facing each other and is open along the plugging direction toward the engaging parts 4. In order to recognize the joint space 12, the engaging part module 4 is shown in FIG. 6 in the left half, at a distance from the plugged final position. Thus, the short circuit contact position for the right spring leg 22 is shown.

The engaging part modules 4 are provided with a separating element 11 in the form of a separating wall 28 located on the first joint side 7 of the engaging part module 4 that projects along the plug direction. The thickness of the separating wall 28 is matched to the width of the joint space 12 between the plug body modules 3, and further, the separating wall 28 is so configured along the plug direction that, when the plug body 1 and engaging part 2 are plugged together, the separating wall 28 of one engaging part module 4 presses into the joint space 12 assigned to it between two adjacent plug body modules 3, whereby the separating wall 28 is pressed between the contact positions 23 of the spring contacts 9 of the one module 3 and the counter-contact 10 of the other module 3 shortly before achievement of the plugged, final position of plug body 1 and engaging part 2, and thereby removes the short circuit, as the right half of FIG. 7 shows.

When the plug body 1 and engaging part 2 are in plugged position, the separating wall 28 of the outer plug body module 4 on the one side lying outward covers the first joint side 5 of the opposing, inserted, outer plug body module 2 on the one side (right half of FIGS. 6 and 7) to the extent that the exposed counter-contact 10 on this joint side of the plug body module 3 is covered. For the plug body module 3 on the opposite side of the plug body 1 pointed outward, the exposed, second joint side 6 may be enclosed by means of a cover (not shown) in order to make the spring contacts 9 located here inaccessible.

The present invention is not intended to be limited to a system or method that must satisfy one or more of any stated or implied objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A plug connector assembly including at least a first and a second plug connector, each plug connector consisting of a single pole connector having a plug body (1) and an engaging part (2), whereby each plug body (1) is provided with short circuit contacts that consist of spring contacts (9) and counter-contacts (10), and whereby the spring contacts (9) of said first plug connector contacts the counter-contacts of said second plug connector in a non-plugged position of plug body (1) and engaging part (2) of each plug connector, and wherein the short circuit contacts short-circuit a first conductor coupled to said plug body (1) of said first plug connector to a second conductor coupled to said second plug connector, whereby further each of the engaging parts (2) include at least one separating element (11) of an insulating material that, in a plugged position of the plug body (1) and the engaging part (2), is pressed into the plug body (1) thereby eliminating the short circuit between the spring contacts (9) of the first plug connector and the counter-contacts (10) of the second plug connector, wherein each plug body (1) consists of modules (3) that are configured to be positioned one against the other, and each engaging part (2) consists of modules (4) that are configured to be positioned one against the another, whereby each of the plug body modules (3) include on a first joint side (5) a counter-contact (10) and on a second, opposing joint side (6) at least one spring contact (9) having at least one contact position (23), and whereby the contact position (23) is disposed at a height that is the same height as the counter-contact (10) on an adjacent plug body-modules (3), and further, wherein the plug body-modules (3) are so formed at least on one of their joint sides (5, 6) such that a joint space (12) exists between the joint sides (5, 6) of adjacent plug body-modules (3) and that spring contacts (9) and the counter-contact (10) of an adjacent plug body-modules (3) contact each other, and further, whereby each of the engaging part-modules (4) include a separating element (11) that is configured to fit into the joint spaces (12) in a position between the spring-contacts (9) and the counter-contacts (10) between adjacent plug body modules (3) when in the plugged position, thereby eliminating the short circuit between the spring contacts (9) of the first plug connector and the counter-contacts (10) of the adjacent second plug connector.

2. A plug connector as in claim 1, wherein the separating element (11) of one of the two engaging part modules (4), when in the plugged position, extends over the counter-contact (10) on an exposed joint side (5 or 6) of the adjacent plug body module (3).

3. A plug connector as in claim 1, wherein the plug body and engaging part modules (3, 4) possess projecting plug lugs (13) and corresponding plug sockets (14) on their joint sides (5, 6).

4. A plug connector as in claim 1, wherein the plug body and engaging part modules (3, 4) each possess engaging hooks (15) and matching engaging members (16).

5. A plug connector as in claim 1, wherein each plug body module (3) includes a short circuit contact piece (19) which forms the spring contacts (9) and the counter-contacts (10) of said plug body module.

6. A plug connector as in claim 1, wherein the plug body module (3) and the engaging part module (4) possess working contacts (17, 18) whose engagement precedes separation of the short circuit contacts (9, 10) during a plugging together process.

7. A plug connector as in claim 1, wherein the engaging part modules (4) include a separating wall as the separating element (11) that projects along a plug direction and that is positioned as an extension of one of the joint sides (5, 6) of each engaging part module (4).

8. A plug connector as in claim 7, wherein the contact piece (19) includes a region forming a contact plate (20) that includes an exposed contact area (21) on the first joint side (5) of the module (3), and that forms the counter-contact (10).

9. A plug connector as in claim 8, wherein the contact piece (19) includes at least one spring leg (22) having a contact region (23) forming the spring contact (9), said contact region (23) positioned on the contact plate (20) at a same height as the contact area (21) and wherein said contact region (23) projects outwardly from the second joint side (6) of the module (3) when in a non-contact, relaxed position.

10. A plug connector as in claim 9, wherein the spring leg (22) including the contact region (23) is shaped by means of a bend joint (24) as one piece with the contact plate (20) of the contact piece (19).

11. A plug connector as in claim 9, wherein the contact piece (19) includes two spring legs (22) each including a contact region (23), and wherein the contact area (21) of the contact plate (20) is configured to match to the simultaneous contact of two such spring legs (22).

* * * * *